US006565492B1

(12) United States Patent
Kurz

(10) Patent No.: US 6,565,492 B1
(45) Date of Patent: May 20, 2003

(54) RHYTHMIC MOTION DRIVER

(76) Inventor: Norman Kurz, 451 14th St., Brooklyn, NY (US) 11215

( * ) Notice: Subject to any disclaimer, the term of this patent is extended or adjusted under 35 U.S.C. 154(b) by 67 days.

(21) Appl. No.: 09/631,558

(22) Filed: Aug. 3, 2000

Related U.S. Application Data

(62) Division of application No. 09/338,306, filed on Jun. 22, 1999.

(51) Int. Cl.[7] ..... A63B 21/02

(52) U.S. Cl. ..... 482/121; 482/44; 482/110; 446/236

(58) Field of Search ..... 482/44, 92, 110, 482/121, 122, 127, 129, 135, 136, 139, 148; 601/23; 446/236, 237, 256, 259, 260

(56) References Cited

U.S. PATENT DOCUMENTS 4,938,474 A * 7/1990 Sweeney et al. ..... 482/52
6,149,612 A * 11/2000 Schnapp et al. ..... 601/23

* cited by examiner

*Primary Examiner*—Nicholas D. Lucchesi
*Assistant Examiner*—Tam Nguyen
(74) *Attorney, Agent, or Firm*—Gibbons, Del Deo, Dolan, Griffinger & Vecchione

(57) ABSTRACT

A rhythmic motion driver having a case containing flywheels. A spring is within the case that compresses and expands in response to oscillatory motion of a bar that extends through an opening in the case. The spring compression and expansion is slowed but not dampened by the movement of the flywheels.

4 Claims, 1 Drawing Sheet

RHYTHMIC MOTION DRIVER

This application is a division of Ser. No. 09/338,306 filed Jun. 22, 1999.

BACKGROUND OF THE INVENTION

1. Field of the Invention

The invention relates broadly to exercise machines.

2. Discussion of Related Art

In the field relating to sport training devices and exercise machines, the prior art is, with few exceptions, devoted to machines in which the user moves continually or repeatedly against a resisting force. But the prior art overlooks the significant advantages of combining basic mechanical technologies in a way that allows a machine to translate the exertions of the user into a controlled rhythmic motion that in turn has sufficient momentum, independently of the user's body weight, to act back upon the user, coaxing him to assume the rhythmic pattern of motion produced by the machine.

The current invention, a rhythmic motion driver, is intended to be a basic machine unit, able to be easily employed in a large variety of ways. The invention makes possible a new method of machine-assisted exercise and recreational body movement, based upon inducing a user to maintain a rhythm with his hands, feet, or body. As an alternative to working only against a resisting force, as in most currently existing machines in this field, it becomes possible with the invention to work in resonance with a rhythmic motion.

Currently existing user-powered exercise machines tend to stop, or return to an initial position and stop, at the moment a user ceases his exertions, because the motion of the machine is resisted. Indeed, much attention in the prior art has understandably been focused upon providing a suitable means of resistance to the force exerted by the user. The work expended by the user of the machines in this field, is expended in overcoming such resistance, whether by lifting a weight, compressing or extending a spring, bending a flexible rod, turning a flywheel against a restraining force, or by moving against a pneumatic, hydraulic or electromagnetic resistance device, and it is this work that provides the essential benefit of these machines to the user, such as muscle building or aerobic training.

However, continually working against a resisting force produces an experience that is inherently motivational only for a few; it is an experience of work only, and much of the motivation is usually not the experience itself, but the desire for the perceived benefit. Whereas, a more a playful movement, such as a movement to the rhythm of dance, for example, is inherently motivational for many. Despite the fact that there is work being done, the body experiences pleasure in "going with" a movement that seems, in turn, to carry it along. The rhythmic method of machine exercise, which does in fact carry the body along to some degree in a rhythmic pattern has, therefore, a distinct motivational advantage over the all-work experience of action against a resisting force. And because the exercise experience itself is more pleasurable, the rhythmic method of machine exercise is less likely than existing machines to be abandoned by the user when the novelty of it has worn off, and is therefore likely to contribute significantly to the commercial market and to the total amount of machine exercise actually being done.

BRIEF SUMMARY OF THE INVENTION

The rhythmic motion driver is a self-contained unit with the rhythmic action immediately utilizable by attaching a handle, pedal or moving structural component, to an attachment bar of the driver. This self-contained characteristic of the driver offers further considerable advantages over machines built with an elaborate specific configuration for a particular type of exercise, because employing the driver in various ways makes possible the simple construction of a wide range of exercisers. The driver, with attached handle, can be secured to a wall or doorway, for example, for use in its simplest form. In more complex forms, a suitable frame can be designed to secure the driver, or a number of drivers, in a particular position that puts the rhythmic motion along any desired path. Simple adjustable but stationary mountings on a frame, allowing the rhythmic motion driver unit to be adjusted as to position and angle, make possible custom machine configurations without re-designing the structural elements of a machine.

Further, by having a frame hold in position separate rhythmic motion drivers, each hand of a user, for example, can be compelled into a rhythmic motion independently of the other hand. A new element of machine versatility is automatically introduced by such a configuration, because a user can change the exercise being performed simply by exerting a greater effort in resonance with, or in resistance to, the rhythmic motion of one hand than he does in regard to the motion of the other hand. Acting to enhance or resist the rhythmic motion will slowly change the rhythm of the driver. The user can, for example, move gradually and seamlessly from a rhythmic pattern wherein the motions of the two hands move exactly opposite to each other, to a pattern where the two hands are moving back and forth together. A simple arrangement of multiple rhythmic motion drivers can therefore introduce significant elements of variety and change, as well as challenges of coordination, into the exercises performed.

But most notable perhaps of all the unique features of rhythmic motion machine exercise, is that more than one rhythmic motion driver can be joined together, such a combination imparting to one pedal, for instance, two independent rhythmic motions perpendicular to each other simultaneously. The result of such an arrangement is that the path of the pedal can assume a number of shapes in a single plane, such as circular or a generally elliptical figure, or, if the period of the motion in one direction is about twice as fast as in the other direction, even a figure eight pattern. In the most usual case, with a generally elliptical shape of the pedal path, appropriate exertions can cause the axes of the elliptical figure to rotate, so that the path will change gradually from an ellipse elongated horizontally to an ellipse elongated vertically and so forth. In this way, all points within a defined area of a plane are possible positions of such a pedal as it moves along one path or another, in stark contrast to any existing machine.

Many combinations are made possible by the independence of multiple rhythmic motions, but a further notable arrangement can be accomplished by joining to the two perpendicular rhythmic motions mentioned above, a third independent rhythmic motion perpendicular to each of the other two. Such an arrangement can be used to incorporate the third physical dimension into the path of a handle, for instance, so that the handle makes generally oscillating helical paths that can be varied by the user in a way that makes all points within a defined three dimensional space possible positions of the handle as it moves along one path or another. Either the two dimensional or three dimensional configurations of independent rhythmic motion thus possible allow a freedom and variability of movement of the limbs or body that is unequalled by any existing machine.

DETAILED DESCRIPTION OF THE INVENTION

Figure 2:
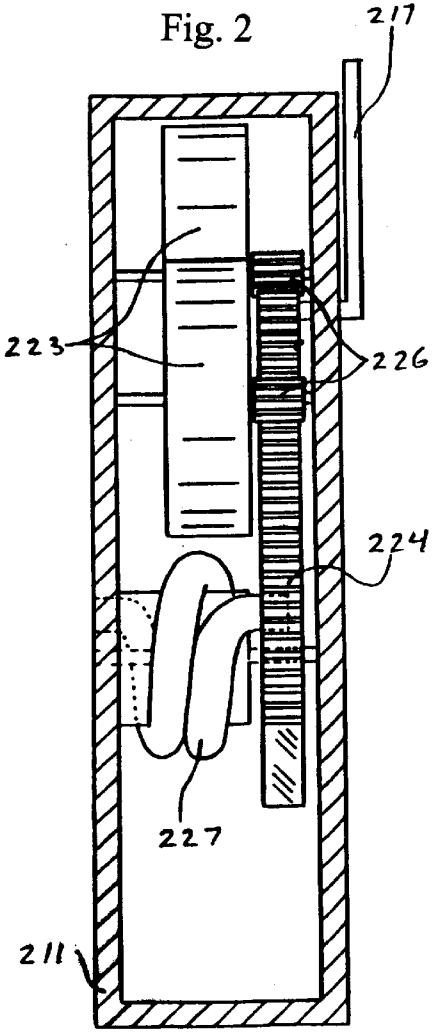
FIG. 2 is a cross-section across 2—2 of FIG. 1.
Figure 1:
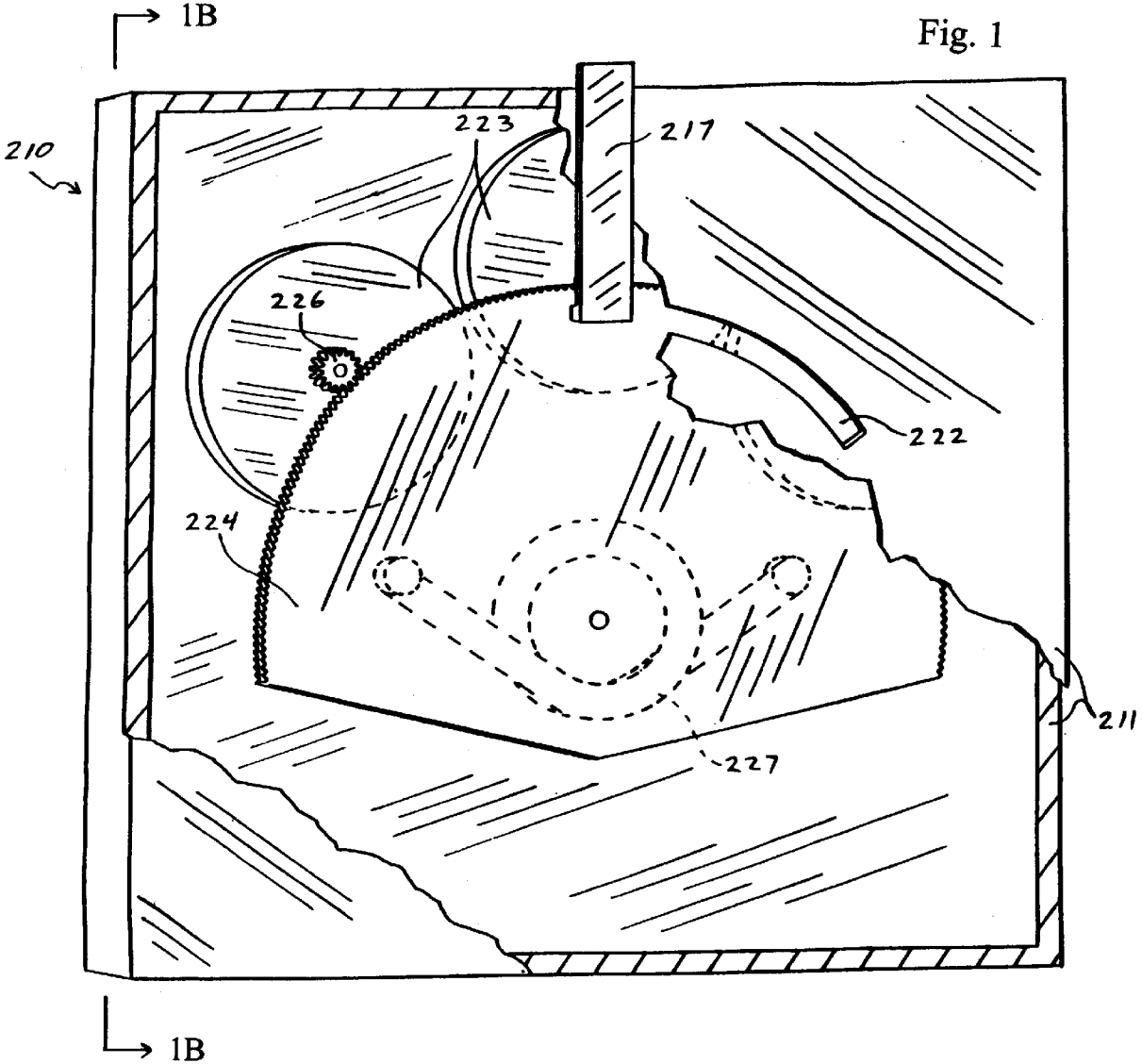
FIG. 1 is partially broken plan view of rhythmic motion driver in accordance with a third embodiment.

Turning to FIGS. 1–2, the current embodiment is illustrated generally at 210, and employs a rack and pinion system to engage flywheels 223. The guiding means controlling the movement of one member of the rhythmic motion driver with respect to the other is a pivot. An effect of using a pivot as a guiding means is that the path of an attachment bar 217 is an arcuate path.

The rhythmic motion driver, as illustrated at 210, includes flywheels 223 rotatably mounted to the outer frame 211, and gears 226 mounted rigidly and co-axially with respect to the flywheels. The gears 226 are engaged by a partial wheel 224 having a toothed edge. The wheel 224 is rotatably or pivotally mounted to the frame 211.

While it would obviously be possible to mount the flywheels 223 on the pivotable wheel 224 inside of a movable flywheel assembly, and engage them with a stationary arcuate toothed bar attached to the frame, the illustrated embodiment offers a simpler configuration.

An attachment bar 217 is fixed to the pivotable wheel 224 and extends through a slot in the outer frame 211. The motion of the attachment bar 217 is therefore accompanied by simultaneous angular momentum in the flywheels 223, and is at the same time resisted by a spring 227, attached at one end to the frame 211 and at the other end to the pivotable wheel 224, creating an oscillating system.

What is claimed is:

1. A rhythmic motion driver exercise device, comprising:

(a) a first member capable of being secured in a stationary position, (b) a second member having an attachment bar, said attachment bar structured to enable attachment of a holding means for parts of a human body in motion, (c) a guiding means disposed between said first member and said second member, said guiding means structured to enable a movement of said second member to and fro along a determined path with respect to said first member, said guiding means being a pivot whereby said second member is pivotally mounted to said first member.

(d) an angular momentum storage means mounted on said first member, (e) an engagement means disposed between said angular momentum storage means and said second member, said engagement means structured to continuously engage said angular momentum storage means in a direct correspondence with said movement of said second member enabling translation of said movement to and fro into concurrent rotation and counter-rotation respectively of said angular momentum storage means, (f) a resilient resistance means disposed between said first member and said second member, opposing said movement with sufficient force to cause said movement to stop and reverse, whereby said attachment bar is capable of being driven such that a slow periodic oscillation or rhythmic motion occurs when sufficient momentum is provided by the user which enables exercise based upon user interaction with said rhythmic motion.

2. A rhythmic motion driver exercise device, comprising:

(a) a framework capable of being secured in a stationary position, said framework configured to accommodate a pivotable member, (b) a pivotable member having a first and second end, said member mounted pivotally upon said framework at said first end allowing said second end to move in an arcuate path, (c) a resilient resistance means including a spring connected between said framework and said member, resisting any movement of said second end of said member away from a midpoint of said arcuate path, said spring having sufficient strength to eventually stop and reverse said movement, (d) an angular momentum storage means including a flywheel or plurality of flywheels mounted on said framework, and (e) a linkage means for producing continuous corresponding rotation of said flywheels, and thereby storage of angular momentum, simultaneously with the motion of said second end of said member, whereby said pivotable member is capable of being driven by the user with sufficient force of limited duration such that an oscillation or rhythmic motion of said second end of said member occurs with respect to said framework, enabling exercise based upon user interaction with said rhythmic motion in a handle or pedal attached to said second end of said member.

3. A rhythmic motion driver exercise device, comprising a case having an elongated opening, a wheel within the frame, a bar extending through the opening and attached to the wheel, a spring within the frame and arranged to effect compression and expansion in response to an oscillatory movement by the bar, and flywheels arranged within the frame to move concurrently with the oscillatory movement to slow the compression and expansion of the spring, the flywheels effecting corresponding rotatable movement back and forth, and a gear mounted rigidly and coaxially with respect to the flywheels, the wheel having teeth arranged to mesh with the gear, the wheel being pivotally mounted to the frame, the spring being arranged to resist angular momentum of the flywheels that results from motion of the bar, the spring being attached to the frame and to the wheel.

4. A rhythmic motion driver exercise device comprising:

an attachment capable of oscillatory motion along a predetermined arcuate path;

a spring arranged to effect compression and expansion in correspondence with the oscillatory movement of the attachment;

the compression and expansion of the spring resisting the motion of the attachment away from a midpoint of the arcuate path; and, a flywheel arranged to move concurrently with the oscillatory movement of the attachment and to slow the compression and expansion of the spring.

* * * * *